US012691330B2

(12) United States Patent
Walker

(10) Patent No.: US 12,691,330 B2
(45) Date of Patent: Jul. 28, 2026

(54) FOOT STRENGTHENING APPARATUS

(71) Applicant: Kevin Walker, Chicago, IL (US)

(72) Inventor: Kevin Walker, Chicago, IL (US)

( * ) Notice: Subject to any disclaimer, the term of this patent is extended or adjusted under 35 U.S.C. 154(b) by 92 days.

(21) Appl. No.: 18/926,144

(22) Filed: Oct. 24, 2024

(65) Prior Publication Data

US 2026/0115530 A1 Apr. 30, 2026

(51) Int. Cl.

| | |
|---|---|
| ***A63B 23/10*** | (2006.01) |
| ***A63B 21/00*** | (2006.01) |
| ***A63B 21/04*** | (2006.01) |
| ***A63B 21/055*** | (2006.01) |
| ***A63B 23/08*** | (2006.01) |

(52) U.S. Cl.

CPC ..... *A63B 23/10* (2013.01); *A63B 21/00069* (2013.01); *A63B 21/0407* (2013.01); *A63B 21/0555* (2013.01); *A63B 23/08* (2013.01)

(58) Field of Classification Search

CPC ..... A63B 23/10; A63B 21/00069; A63B 21/0407; A63B 21/0555; A63B 23/08

See application file for complete search history.

(56) References Cited

U.S. PATENT DOCUMENTS 1,373,211 A * 3/1921 Tanner ..... A61F 5/019 602/30
1,911,390 A * 5/1933 Pullman ..... A63B 23/10 482/79
3,049,120 A * 8/1962 Marcus ..... A61F 5/019 602/30
4,869,499 A * 9/1989 Schiraldo ..... A63B 21/4011 482/79
5,039,093 A * 8/1991 Collier ..... A63B 21/4011 482/79
6,283,897 B1 * 9/2001 Patton ..... A63B 21/055 482/79
7,354,413 B2 * 4/2008 Fisher ..... A61F 5/0113 602/29
8,226,589 B2 * 7/2012 Darby, II ..... A61F 5/0111 602/5
8,403,817 B2 * 3/2013 Ferguson ..... A63B 23/08 482/79
11,052,275 B1 * 7/2021 Garick ..... A63B 21/00065
2003/0092545 A1 * 5/2003 Koscielny ..... A63B 21/0004 482/124
2005/0245363 A1 * 11/2005 Shumrick ..... A63B 23/10 482/79
2007/0100268 A1 * 5/2007 Fisher ..... A61F 5/0113 602/28
2007/0254780 A1 * 11/2007 Findeisen ..... A63B 23/16 482/44

(Continued)

OTHER PUBLICATIONS

KR_20070065253 and English Machine Translation (Year: 2007).*

*Primary Examiner* — Sundhara M Ganesan
(74) *Attorney, Agent, or Firm* — Fraline J. Allgaier

(57) ABSTRACT

An improved foot strengthening apparatus is presented. The foot strengthening apparatus features a system of elastic bands and toe sleeves designed to enhance the strength of the feet, ankles, and calves. The apparatus includes a plurality of elastic bands that provide adjustable tension, which connects to a series of toe sleeves for comfort and circulation. Additionally, the apparatus incorporates guide channels and sliding anchors that facilitate the routing of the elastic bands and secure attachment to an adjustable ankle brace.

13 Claims, 4 Drawing Sheets

(56) References Cited

U.S. PATENT DOCUMENTS

| | | | | |
|---|---|---|---|---|
| 2008/0113854 | A1* | 5/2008 | Ferri | A61F 5/019 482/148 |
| 2008/0154166 | A1* | 6/2008 | Beckwith | A61F 5/0113 602/27 |
| 2010/0256544 | A1* | 10/2010 | Colon | A61F 5/05 602/28 |
| 2011/0124473 | A1* | 5/2011 | Kole | A63B 23/10 482/79 |
| 2016/0030222 | A1* | 2/2016 | Collier | A61F 5/0113 602/27 |
| 2016/0279467 | A1* | 9/2016 | Dickens | A63B 23/16 |
| 2016/0339296 | A1* | 11/2016 | Barel | A63B 23/08 |
| 2019/0201731 | A1* | 7/2019 | Nguyen | A63B 21/4015 |
| 2019/0308060 | A1* | 10/2019 | Matsubara | A63B 23/03508 |
| 2019/0343670 | A1* | 11/2019 | Ruprecht | A61H 1/0274 |
| 2020/0009422 | A1* | 1/2020 | Zbinden | A63B 23/10 |
| 2020/0391075 | A1* | 12/2020 | Mattson | A63B 21/0555 |
| 2020/0406093 | A1* | 12/2020 | Tarkington | A63B 21/4013 |
| 2022/0062085 | A1* | 3/2022 | Farrell | A63B 23/10 |
| 2022/0118307 | A1* | 4/2022 | Chapman | A63B 21/0555 |
| 2022/0118312 | A1* | 4/2022 | Lopez | A61H 1/0266 |
| 2022/0143459 | A1* | 5/2022 | Boesch | A63B 23/10 |
| 2023/0072184 | A1* | 3/2023 | Villarreal, III | A63B 21/4013 |
| 2024/0307206 | A1* | 9/2024 | Bruno | A61F 5/0113 |

* cited by examiner

FOOT STRENGTHENING APPARATUS

FIELD OF THE INVENTION

The present invention relates to a foot strengthening apparatus, and more particularly to an improved system for enhancing the strength of the feet, ankles and calves, which in its preferred embodiment, is a plurality of elastic bands configured to provide adjustable tension in cooperation with a plurality of toe sleeves, guide channels, and sliding anchors.

BACKGROUND OF THE INVENTION

The present invention addresses a prevalent issue in foot health: the weakness of the feet, ankles, and calves, which affects a significant portion of the population. The widespread use of conventional footwear has been shown to impede the natural development of foot muscles, leading to a variety of complications not only in the lower extremities but also throughout the entire body. Weakness in the feet can manifest in discomfort, reduced mobility, and increased risk of injury, underscoring the necessity for effective strengthening solutions.

Traditional methods for enhancing foot strength include exercises such as scrunching a towel with the toes, walking barefoot, towel tugging, foot rolling, and toe pickups. While these exercises can yield beneficial results, they often lack the comprehensive approach necessary for optimal muscle development. Many existing devices designed for foot strengthening are limited in their functionality or do not provide a comfortable user experience, leading to decreased adherence to prescribed routines.

The invention presented herein introduces an innovative foot strengthening apparatus specifically designed to overcome these limitations. This apparatus employs a unique combination of elastic bands, toe sleeves, guide channels, and sliding anchors engineered to provide adjustable resistance through a push-and-pull mechanism. The toe sleeves are crafted to ensure comfort and maintain circulation while incorporating specially designed attachments that connect to the elastic bands. This setup allows for targeted tension on the toes, effectively engaging the foot muscles in a manner that traditional exercises cannot achieve.

SUMMARY

This disclosure presents a foot strengthening apparatus designed to enhance the strength of the feet, ankles, and calves. The apparatus comprises a plurality of elastic bands, each featuring a first retention nodule at one end and a second retention nodule at the opposite end. The elastic bands are vertically arranged to connect between the ankles and the individual toes of a user.

The apparatus includes a plurality of toe sleeves, each equipped with a second interface portion for receiving the second retention nodules of the elastic bands. Additionally, the design incorporates a plurality of guide channels that facilitate the routing of the elastic bands, ensuring efficient tension application.

Sliding anchors are attached to an adjustable ankle brace, allowing for the removable insertion of the first retention nodules of the elastic bands. The interior spaces of both the toe sleeves and sliding anchors accommodate the retention nodules, ensuring a secure fit. Furthermore, the adjustable rubber strap connects the guide channels to the foot, allowing for customizable adjustments during use. This apparatus effectively applies initial force to the elastic bands, removing slack without disengaging from the ankle brace, thereby providing a comprehensive solution for foot muscle strengthening.

Unless otherwise defined, all technical and scientific terms used herein have the same meaning as commonly understood by one of ordinary skill in the art. Although methods and materials similar or equivalent to those described herein can be used in the practice or testing of any described embodiment, suitable methods and materials are described below. In addition, the materials, methods, and examples are illustrative only and not intended to be limiting. In case of conflict with terms used in the art, the present specification, including definitions, will control.

Additional advantages and features of the present invention will become more apparent when considered in light of the following specification and drawings.

BRIEF DESCRIPTION OF THE DRAWINGS

The present embodiments are illustrated by way of the figures of the accompanying drawings, which may not necessarily be to scale, in which like references indicate similar elements, and in which.

DETAILED DESCRIPTION

Figure 1:
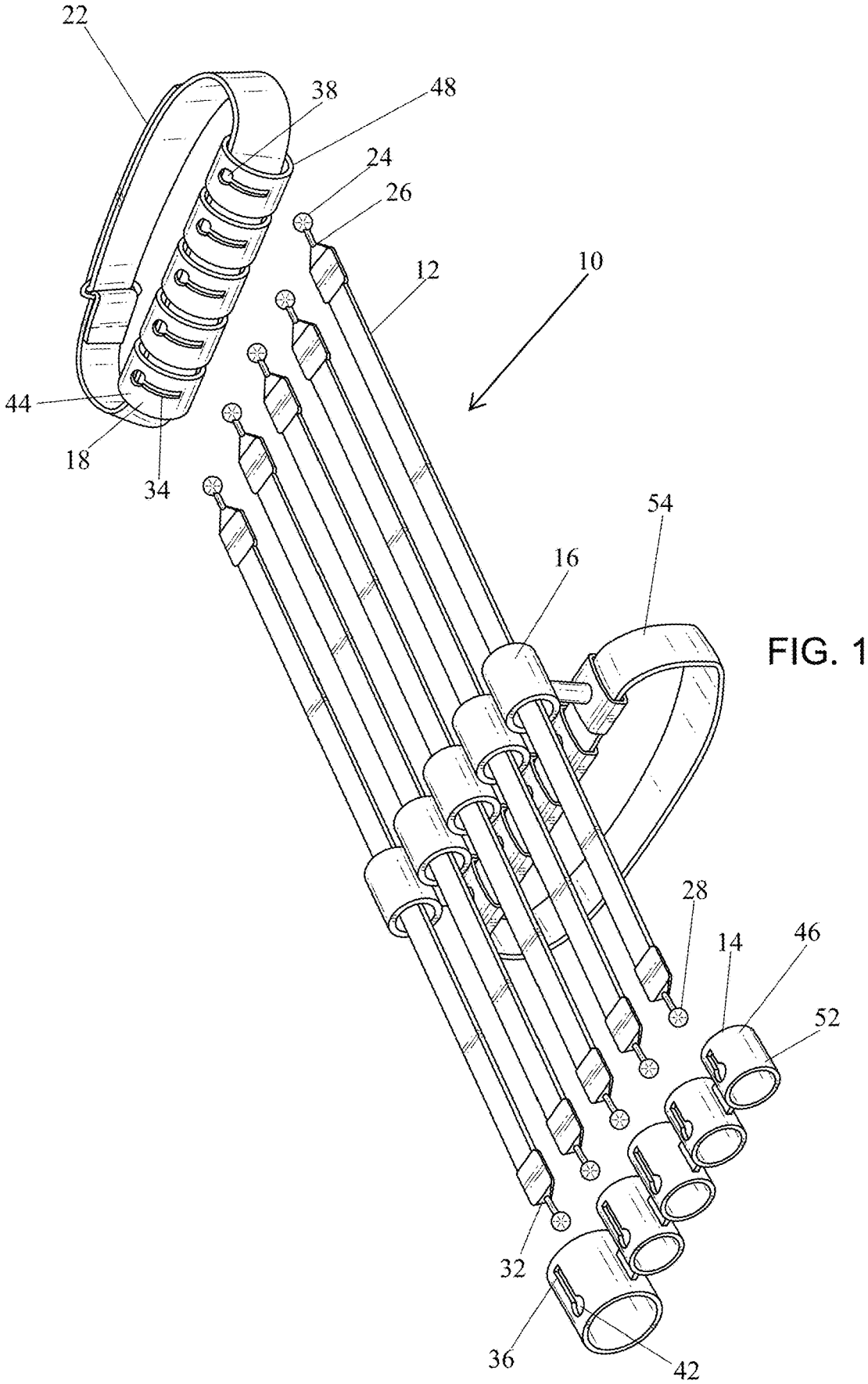
FIG. 1 shows a foot strengthening apparatus with a plurality of elastic bands, a plurality of toe sleeves, a plurality of guide channels, and an adjustable ankle brace in accordance with an embodiment of the present invention.

The following detailed description is a contemplated mode of carrying out a foot strengthening apparatus 10 and method of manufacture described herein. Although the foot strengthening apparatus 10 and method of manufacture are explained in relation to an illustrated embodiment, it is understood that many possible modifications and variations can be made without departing from the spirit and scope of the disclosure.

Therefore, the foot strengthening apparatus 10 is designed for use in various settings, making it a versatile tool for individuals seeking to enhance their foot health. This apparatus 10 can be utilized in residential environments for personal fitness routines, rehabilitation settings for physical therapy, and athletic training facilities where athletes require effective methods to strengthen their lower extremities. The design accommodates a range of users, including those recovering from injuries, fitness enthusiasts, and athletes aiming to improve performance.

It can be appreciated that the implementation of the foot strengthening apparatus 10 as provided herein incorporates the use of elastic bands 12 to create resistance, promoting muscle engagement in the feet, ankles, and calves. The intended users of this apparatus 10 include individuals looking to improve their foot strength through targeted exercises, healthcare professionals recommending rehabilitation tools, and trainers seeking effective methods for enhancing athletic performance. The user-friendly design allows individuals of all skill levels to easily apply and adjust the apparatus 10 as needed.

The arrangement of the elastic bands 12 and toe sleeves 14 can be customized based on the specific needs of the user. The adjustable features of the sliding anchors 18 and guide channels 16 enable users to modify the tension and positioning of the bands 12 to suit their strength levels and exercise preferences. This modular design not only enhances usability but also promotes a comprehensive strengthening experience tailored to the individual.

For construction, the plurality of toe sleeves 14, guide channels 16, and sliding anchors 18 are designed to maintain comfort and circulation while securely housing the retention nodules 24,28 of the elastic bands 12. The materials selected for the toe sleeves 14, guide channels 16, and sliding anchors 18 are chosen for their durability and flexibility, allowing for a snug fit without compromising comfort. These can be constructed from a flexible and lightweight material such as plastic, aluminum, neoprene, or the same that conforms to the anatomical shape of the toe while providing a snug yet comfortable fit. The interior of the sleeve 14 may be lined with a soft, cushioning material to further enhance comfort and reduce friction. Additionally, the design of the sleeve 14 allows for easy application and removal, ensuring that the user can adjust the fit as needed without compromising the functionality of the retention nodules 24,28.

The elastic bands 12 are constructed from high-quality materials that provide adequate tension while withstanding repeated use to provide resistance in connection with the precise repetitive motions. Alternative materials for providing the tension and resistance to the toes of user as provided herein can include flexible cords and other stretchable fabrics that can provide the durability and elasticity required to properly use the apparatus 10.

In a preferred embodiment, the first and second retention nodules 24,28 are designed as circular shaped elements for easy insertion and a secure fit within the respective interfaces 34,36 of the toe sleeves 14 and sliding anchors 18. Cylindrical shapes, flattened nodules, hooks, or the same can be used to enhance the grip and stability within the interfaces 34,36 and reducing the possibility of slippage.

The design of the foot strengthening apparatus 10 emphasizes convenience and efficiency, allowing for quick setup and adjustments without compromising the effectiveness of the exercises. The materials selected for each component are chosen for their ability to endure rigorous training sessions and various foot sizes.

Overall, the inventor proposes the foot strengthening apparatus 10 as an effective and adaptable solution for enhancing foot strength and overall mobility. Its unique features, including adjustable resistance, secure fittings, and user-friendly design, make it an essential tool for anyone aiming to improve their foot health. The potential exists for further customization and variation in the production of this apparatus 10, allowing for different sizes, resistance levels, and materials to appeal to a broader range of users in the health and fitness industries.

For example, and without limitation, FIGS. 1-4 show the foot strengthening apparatus 10 according to one embodiment of the present disclosure for strengthening the feet, ankles, and calves of a person. The foot strengthening apparatus 10 comprising a plurality of elastic bands 12 for providing tension to the toes of a person, a plurality of toe sleeves 14, a plurality of guide channels 16 for facilitating the routing of the plurality of elastic bands 12, and a plurality of sliding anchors 18 attached to an adjustable ankle brace 22. Each elastic band 12 having a first retention nodule 24 added to a first end 26 and a second retention nodule 28 added to a second end 32 thereof and wherein the plurality of elastic bands 12 are vertically arranged for connection from the ankles to the individual toes of a person. The first retention nodule 24 of each elastic band 12 is removably inserted into a first interface 34 portion provided on each sliding anchor 18 of the adjustable ankle brace 22 and wherein the second retention nodule 28 of each elastic band 12 is threaded through each raised guide channel 16 further stretched for insertion of the second retention nodule 28 into a second interface 36 portion provided on each outward facing toe sleeve 14.

The plurality of toe sleeves 14 and the plurality of sliding anchors 18 include interior spaces 38, 32 disposed between a top surface 44,46 and a bottom surface 48,52 respectively for receiving the first and the second retention nodules 24,28 of the plurality of elastic bands 12. The first and the second retention nodules 24,28 of the plurality of elastic bands 12 are configured to engage the first interface 34 portions of the plurality of sliding anchors 18 and the second interface 36 portions of the plurality of toe sleeves 14 respectively to apply an initial force to the plurality of elastic bands 12 and to remove slack therefrom without disengaging from the adjustable ankle brace 22.

The plurality of guide channels 16 are slidably connected to an adjustable rubber strap 54 and wherein the adjustable rubber strap 54 is connected to the foot of a person. The adjustable rubber strap 54 features a single-strap configuration that serves a dual purpose as both a foot anchor and a housing for the plurality of guide channels 16. The adjustable rubber strap 54 extends along the width of the foot. Once the elastic bands 12 are threaded through the channels as provided herein, the channels become adjustably interconnected for effective force transmission from the elastic bands 12 and are movable along the surface thereof 54 as desired by a user. As the user engages with the apparatus 10, the elastic bands 12 stretch and contract through these channels, creating a controlled resistance that enhances the strengthening effect on the toes, feet, and calves. This interaction ensures that the tension is evenly distributed, promoting balanced muscle activation and reducing the risk of strain during use.

The plurality of toe sleeves 14, guide channels 16, and sliding anchors 18 of the foot strengthening apparatus 10 are arranged to correspond to the five toes of a person and are arranged side-by-side in a linear arrangement and placed sequentially on each toe. The plurality of toe sleeves 14 being distinct and tailored for each toe and each sleeve 14 acts as a separate segment along the toe line extending outward and in a vertical direction from the plurality of elastic bands 12. The first and second interfaces 34,36 of the ankle attachment and the toe sleeves 14 respectively are formed in such a manner that they are located on a linear plane.

The retention nodules 24,28 once inserted into the second interfaces 36 of the plurality of toe sleeves 14, are designed to prevent direct contact with the user's toes. The construction of the toe sleeve 14 ensures that the nodule 28 remains positioned away from the toe surface, providing a comfortable fit. This feature allows for effective tensioning of the elastic band 12 without causing discomfort or abrasion to the toes during use.

The plurality of guide channels 16 are aligned with the plurality of toe sleeves 14 in a parallel configuration thereby facilitating a secure connection of the first retention nodule 24 of each elastic band 12 to the first interface 34 portion of each sliding anchor 18 and the second retention nodule 28 of each elastic band 12 to the second interface 36 portion of each toe sleeve 14 for effective force transmission to the toes of a person.

Each sliding anchor 18 of the foot strengthening apparatus 10 is movably connected to the adjustable ankle brace 22 and wherein each sliding anchor 18 is configured to receive and hold each retention nodule 24 of the plurality of elastic bands 12 thereby allowing for movement of the plurality of elastic bands 12 along the adjustable ankle brace 22.

Figure 2:
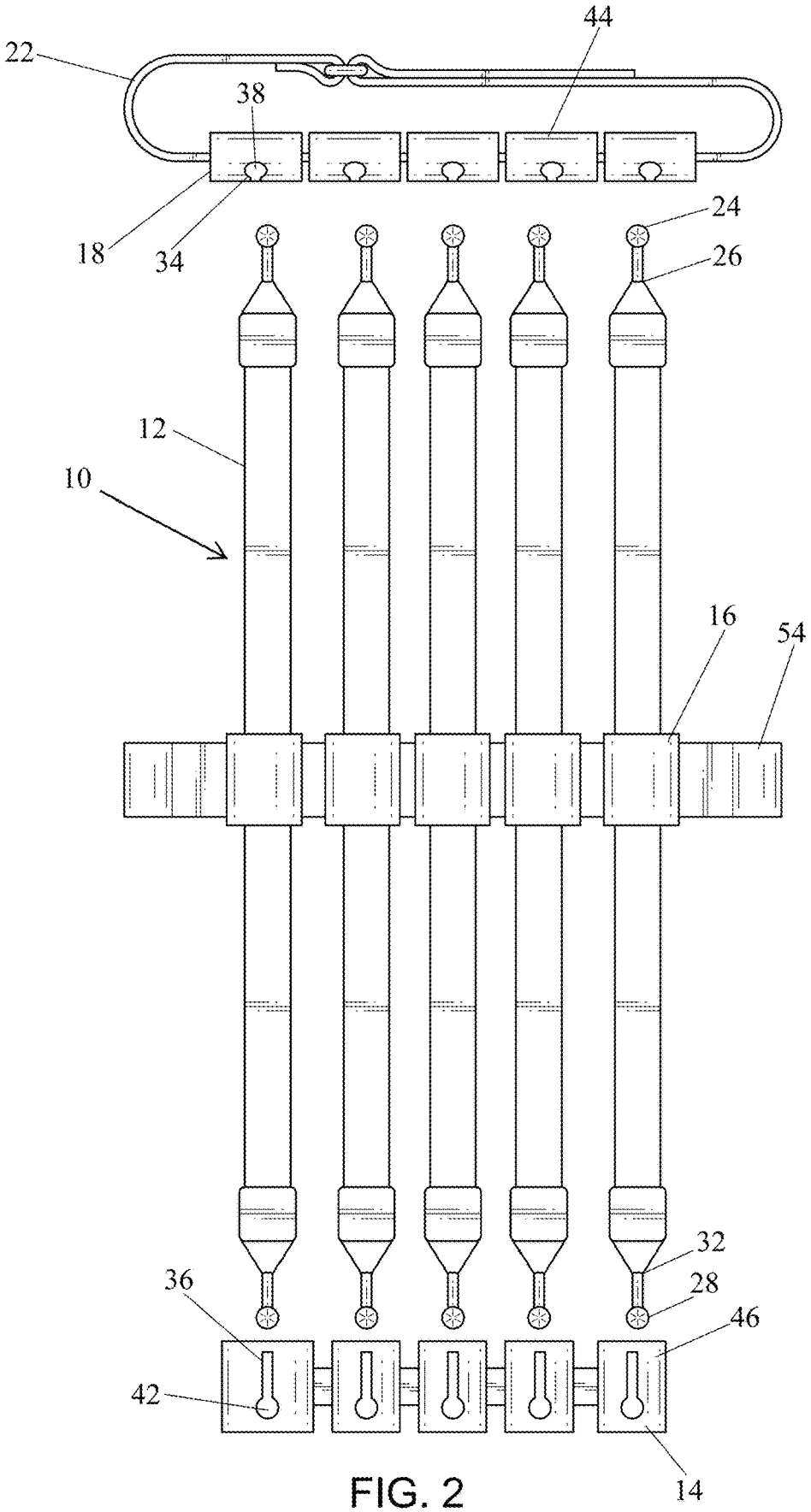
FIG. 2 shows a top view of a foot strengthening apparatus as provided herein having the elastic band in parallel arrangement and corresponding with a plurality of toe sleeves and a plurality of guide channels.
Figure 3:
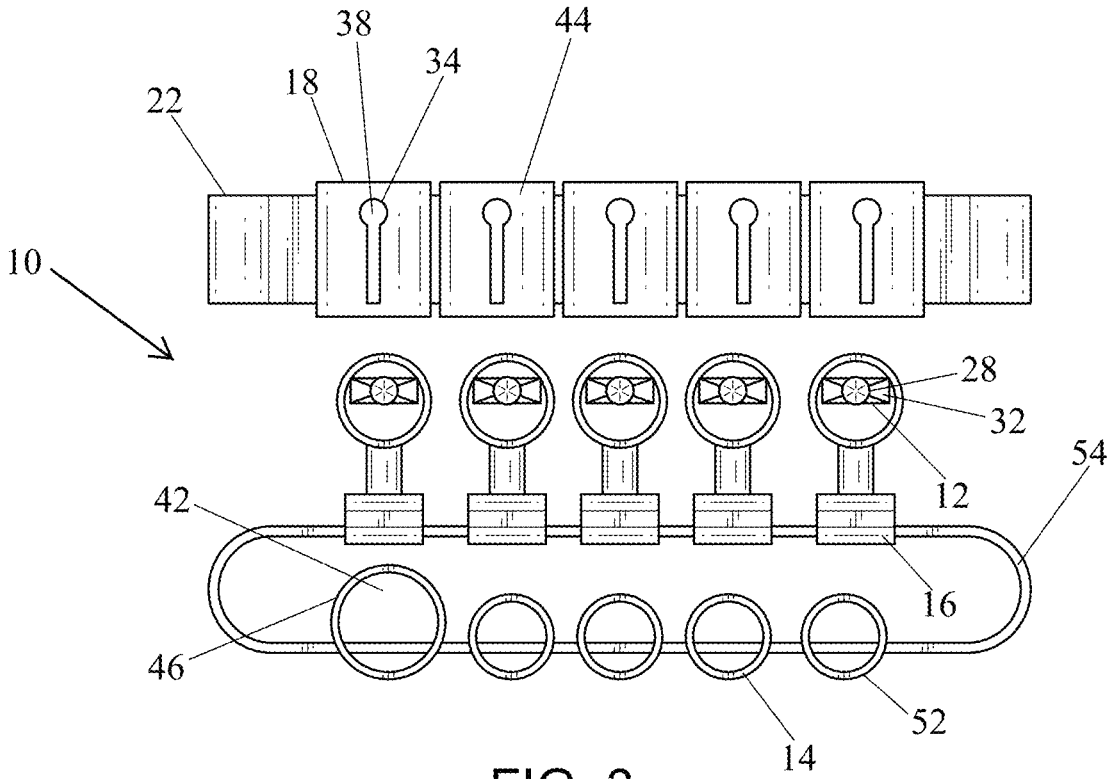
FIG. 3 illustrates a side view of the plurality of elastic bands, the plurality of toe sleeves, and the plurality of guide channels in a linear arrangement and in accordance with an embodiment of the present invention.
Figure 4:
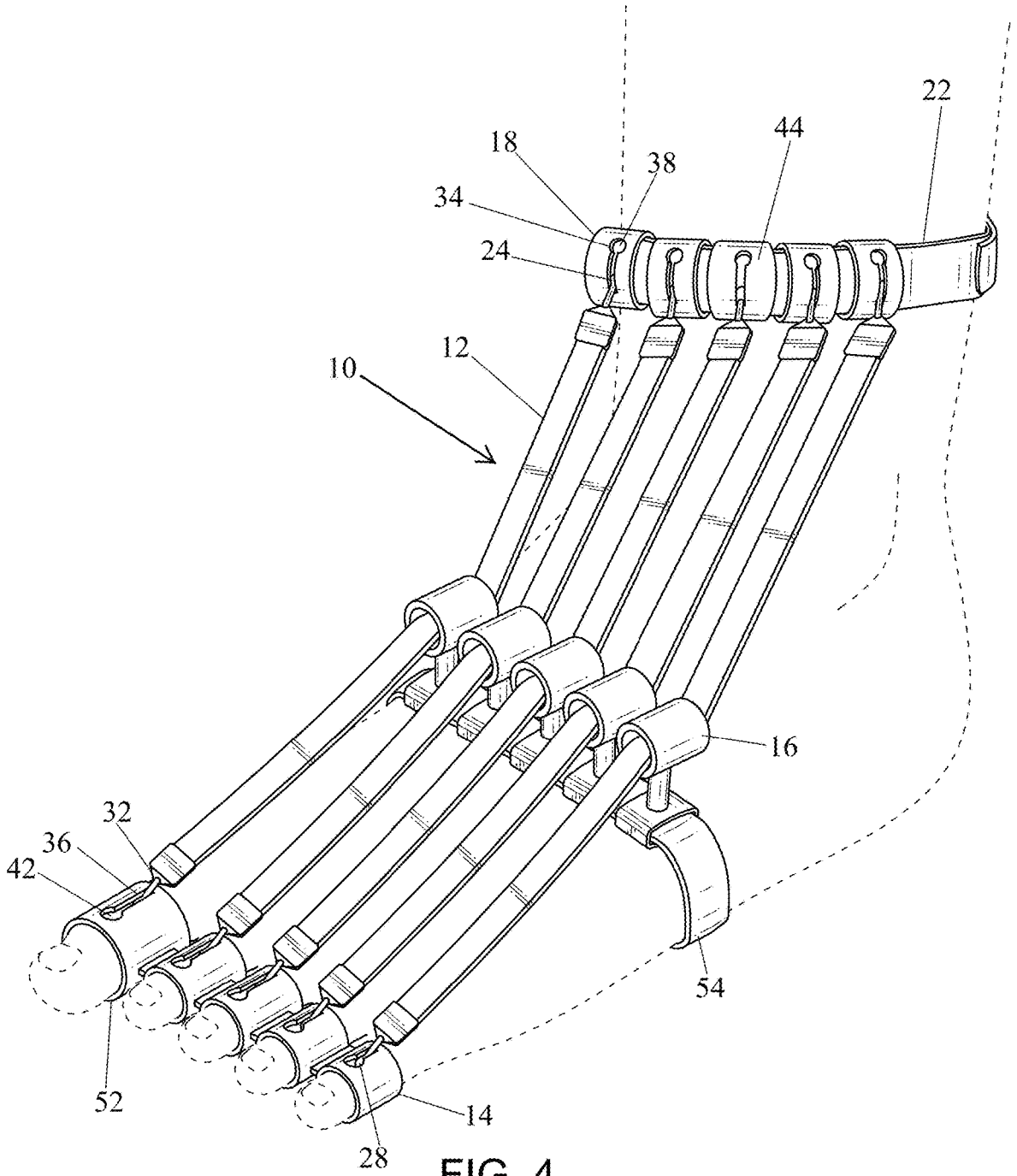
FIG. 4 illustrates an operation of the foot strengthening device in accordance with an embodiment of the present invention.

In an embodiment and as shown in FIGS. 1 and 2, each ankle brace 22 includes a fastener for adjustment of the apparatus 10 around the ankle of a user. This fastener can include a releasable side buckle including a single or a double ring Velcro that is slidably adjustable on corresponding parts of the ankle thereby allowing the precise portion of the adjustable ankle brace 22 to be adjusted thereon.

The ankle brace 22 should be arranged around the ankle to allow the toes to move freely and to allow the full range of motion. This creates comfortable tension with the adjustable ankle brace 22 at one end and the overall tension applied by the elastic bands 12. Adjusting the ankle brace 22 changes the position of the sliding anchors 18, which in turn alters the starting tension of the elastic bands 12. This allows users to customize the resistance level based on their strength and training goals. The ability to adjust the ankle brace 22 can facilitate progressive resistance training and as users become stronger, they can increase the tension by adjusting the ankle brace 22, thereby promoting continuous improvement in strength and endurance.

Having described my invention, however, many modifications thereto will become apparent to those skilled in the art to which it pertains without deviation from the spirit of the invention as defined by the scope of the appended claims. Although the invention has been explained in relation to its preferred embodiment, it is to be understood that many other possible modifications and variations can be made without departing from the spirit and scope of the invention.

What is claimed is:

1. A foot strengthening apparatus to strengthen the feet, ankles, and calves of a person, the foot strengthening apparatus comprising:

a plurality of elastic bands for providing tension to the toes of a person, a plurality of toe sleeves, a plurality of guide channels for facilitating the routing of the plurality of elastic bands, and a plurality of sliding anchors attached to an adjustable ankle brace;

each elastic band having a first retention nodule added to a first end and a second retention nodule added to a second end thereof;

wherein the plurality of elastic bands are vertically arranged for connection from the ankles to the individual toes of a person and wherein the first retention nodule of each elastic band is removably inserted into a first interface portion provided on each sliding anchor of the adjustable ankle brace and wherein the second retention nodule of each elastic band is threaded through each guide channel further stretched for insertion of the second retention nodule into a second interface portion provided on each outward facing toe sleeve;

wherein the plurality of toe sleeves and the plurality of sliding anchors include interior spaces disposed between a top surface and a bottom surface respectively for receiving the first and the second retention nodules of the plurality of elastic bands;

wherein the first and the second retention nodules of the plurality of elastic bands are configured to engage the first interface portions of the plurality of sliding anchors and the second interface portions of the plurality of toe sleeves respectively to apply an initial force to the plurality of elastic bands and to remove slack therefrom without disengaging from the adjustable ankle brace; and wherein the plurality of guide channels are slidably connected to an adjustable rubber strap and wherein the adjustable rubber strap thereof is connected to the foot of a person.

2. The foot strengthening apparatus of claim 1 wherein the plurality of toe sleeves, guide channels, and sliding anchors of the foot strengthening apparatus are arranged to correspond to the five toes of a person.

3. The foot strengthening apparatus of claim 1 wherein the plurality of toe sleeves of the foot strengthening apparatus are removably connected to the toes of a person and the plurality of toe sleeves are arranged side-by-side in a linear arrangement and placed sequentially on each toe and extend outward and in a vertical direction from the plurality of elastic bands.

4. The foot strengthening apparatus of claim 1 wherein the plurality of guide channels are aligned with the plurality of toe sleeves in a parallel configuration thereby facilitating a secure connection of the first retention nodule of each elastic band to the first interface portion provided of each sliding anchor and the second retention nodule of each elastic band to the second interface portion of each toe sleeve for effective force transmission to the toes of a person.

5. The foot strengthening apparatus of claim 1 wherein each sliding anchor of the foot strengthening apparatus is movably connected to the adjustable ankle brace.

6. The foot strengthening apparatus of claim 1 wherein the plurality of sliding anchors of the foot strengthening apparatus are configured to receive and hold each retention nodule of the plurality of elastic bands thereby allowing for movement of the plurality of elastic bands along the adjustable ankle brace.

7. A method of construction of a foot strengthening apparatus to strengthen the feet, ankles, and calves of a person, said method comprising the steps of:

obtaining a plurality of elastic bands for providing tension to the toes of a person, a plurality of toe sleeves, a plurality of guide channels for facilitating the routing of the plurality of elastic bands, and a plurality of sliding anchors attached to an adjustable ankle brace;

each elastic band having a first retention nodule added to a first end and a second retention nodule added to a second end thereof;

arranging the plurality of elastic bands in a vertical configuration for connection from the ankles to the individual toes of a person and wherein the first retention nodule of each elastic band is removably inserted into a first interface portion provided on each sliding anchor of the adjustable ankle brace and wherein the second retention nodule of each elastic band is threaded through each guide channel further stretched for insertion of the second retention nodule into a second interface portion provided on each outward facing toe sleeve;

providing the plurality of toe sleeves and the plurality of sliding anchors with interior spaces disposed between a top surface and a bottom surface respectively for receiving the first and the second retention nodules of the plurality of elastic bands;

configuring the first and the second retention nodules of the plurality of elastic bands to engage the first interface portions of the plurality of sliding anchors and the second interface portions of the plurality of toe sleeves respectively to apply an initial force to the plurality of elastic bands and to remove slack therefrom without disengaging from the adjustable ankle brace; and connecting the plurality of guide channels in a slidable relationship to an adjustable rubber strap and wherein the adjustable rubber strap is connected to the foot of a person.

8. A foot strengthening apparatus to strengthen the feet, ankles, and calves of a person, the foot strengthening apparatus comprising:

a plurality of elastic bands for providing tension to the toes of a person, a plurality of toe sleeves, a plurality of guide channels for facilitating the routing of the plurality of elastic bands, and a plurality of sliding anchors attached to an adjustable ankle brace;

each elastic band having a first retention nodule added to a first end and a second retention nodule added to a second end thereof;

wherein the plurality of elastic bands are vertically arranged for connection from the ankles to the individual toes of a person and wherein the first retention nodule of each elastic band is removably inserted into a first interface portion provided on each sliding anchor of the adjustable ankle brace and wherein the second retention nodule of each elastic band is threaded through each raised guide channel further stretched for insertion of the second retention nodule into a second interface portion provided on each outward facing toe sleeve;

wherein the plurality of toe sleeves and the plurality of sliding anchors include interior spaces disposed between a top surface and a bottom surface respectively for receiving the first and the second retention nodules of the plurality of elastic bands;

wherein the first and the second retention nodules of the plurality of elastic bands are configured to engage the first interface portions of the plurality of sliding anchors and the second interface portions of the plurality of toe sleeves respectively to apply an initial force to the plurality of elastic bands and to remove slack therefrom without disengaging from the adjustable ankle brace;

wherein the plurality of guide channels are slidably connected to an adjustable rubber strap and wherein the adjustable rubber strap is connected to the foot of a person; and wherein each ankle brace includes a fastener for adjustment of the apparatus around the ankle of a user.

9. The foot strengthening apparatus of claim 8 wherein the plurality of toe sleeves, guide channels, and sliding anchors of the foot strengthening apparatus are arranged to correspond to the five toes of a person.

10. The foot strengthening apparatus of claim 8 wherein the plurality of toe sleeves of the foot strengthening apparatus are removably connected to the toes of a person and the plurality of toe sleeves are arranged side-by-side in a linear arrangement and placed sequentially on each toe and extend outward and in a vertical direction from the plurality of elastic bands.

11. The foot strengthening apparatus of claim 8 wherein the plurality of guide channels of the foot strengthening apparatus are aligned with the plurality of toe sleeves in a parallel configuration thereby facilitating a secure connection of the first retention nodule of each elastic band to the first interface portion provided of each sliding anchor and the second retention nodule of each elastic band to the second interface portion of each toe sleeve for effective force transmission to the toes of a person.

12. The foot strengthening apparatus of claim 8 wherein each sliding anchor of the foot strengthening apparatus is movably connected to the adjustable ankle brace.

13. The foot strengthening apparatus of claim 8 wherein the plurality of sliding anchors of the foot strengthening apparatus are configured to receive and hold each retention nodule of the plurality of elastic bands thereby allowing for movement of the plurality of elastic bands along the adjustable ankle brace.

* * * * *